US005234188A

United States Patent [19]

McSwain

[11] Patent Number: 5,234,188

[45] Date of Patent: Aug. 10, 1993

[54] STRUCTURAL SUPPORTING SYSTEM FOR CONCRETE CONSTRUCTION FORMS

[76] Inventor: Gregoary A. McSwain, 4448 Schmittwoods, St. Louis, Mo. 63123

[21] Appl. No.: 868,957

[22] Filed: Apr. 16, 1992

Related U.S. Application Data

[62] Division of Ser. No. 383,540, Jul. 24, 1989, abandoned.

[51] Int. Cl.[5] ..... E04G 11/00

[52] U.S. Cl. ..... 248/201; 248/316.4; 248/231.4; 52/632; 403/341

[58] Field of Search ..... 248/201, 214, 316.4, 248/228, 231.4; 52/632, 702; 403/393, 373, 341

[56] References Cited

U.S. PATENT DOCUMENTS

| | | | |
|---|---|---|---|
| 1,414,756 | 5/1922 | Starck | 403/393 X |
| 2,415,207 | 2/1947 | Goranson . | |
| 2,993,254 | 7/1961 | Larson | 403/393 X |
| 3,045,786 | 7/1962 | De La Rambelje . | |
| 3,330,086 | 7/1967 | Schlass et al. . | |
| 4,342,440 | 8/1982 | Eyden . | |
| 4,856,252 | 8/1989 | Cornell . | |
| 4,913,016 | 4/1990 | Frei | 403/393 X |

FOREIGN PATENT DOCUMENTS

| | | | |
|---|---|---|---|
| 180714 | 6/1955 | Austria | 52/632 |
| 186835 | 9/1956 | Austria | 52/632 |
| 903103 | 7/1949 | Fed. Rep. of Germany | 403/393 |
| 810081 | 12/1953 | Fed. Rep. of Germany | 52/632 |
| 1119804 | 6/1956 | France . | |
| 1187154 | 9/1959 | France | 52/632 |
| 729650 | 5/1955 | United Kingdom . | |

*Primary Examiner*—Karen J. Chotkowski
*Attorney, Agent, or Firm*—Paul M. Denk

[57] ABSTRACT

A structural supporting system for use as a temporary support in concrete falsework construction and the like is disclosed. The structural supporting system includes a series of overlapping form beams and a plurality of cooperating brackets positioned along the length of the overlapping form beams. A bracket is provided at the opposite free ends of the overlapping form beams for mounting the overlapping form beams in the temporary concrete construction support. At least one other bracket, and preferably two other such brackets are positioned intermediate the opposite free ends of the overlapping form beams in order to provide adjustable extension and collapse of the overlapping form beams, so as to increase or reduce the span of the overlapping form beams, as desired. The end brackets at the opposite free ends of the overlapping form beams include an integral support ear which extends laterally outwardly from the end brackets and an adjacent free end of the overlapping form beams for attachment to a fastener suspended from the concrete form construction or other support. The intermediate bracket or brackets include adjustable upper and lower opposed gripping surfaces for engaging corresponding upper and lower surfaces of the overlapping form beams, in adjustable mounted relationship thereto.

6 Claims, 3 Drawing Sheets

STRUCTURAL SUPPORTING SYSTEM FOR CONCRETE CONSTRUCTION FORMS

This is a divisional application of the application of the same inventor filed in the U.S. Pat. Office on Jul. 24, 1989, under Ser. No. 07/383,540 and now abandoned.

BACKGROUND OF THE INVENTION

The present invention relates to a concrete form structural supporting system, and more particularly, to a structural supporting or adjustable waler system for use as a temporary support, such as in concrete falsework forming for bridge deck, concrete slab construction and the like.

Various types of structural undergirders or spanning systems are used to underlie concrete falsework forms in bridge deck and concrete slab construction and the like. Most of such spanning systems incorporate telescopic members that also serve as a structural supporting components in the system. For example, one such system made by Rex-Spannall, Inc. of Milwaukee, Wis. includes a telescopic girder assembly in which tapered bearing flanges on an inner member slidably telescopically interfit relative to double bearing flanges on an outer member. To reduce the weight of the overall telescopic girder assembly, the side walls of the outer member are open except for a continuous reinforcing bar extending in a side-wave pattern so as to interconnect the upper and lower portions of the outer member. This provides an open side wall which reduces the weight of the outer member, and yet provides desired load bearing capacity in a minimum-weight member. Despite the reduction in weight of the outer and inner members in such a device, the outer member is typically provided with spaced supporting wheels to assist in telescopically adjusting the inner and outer members relative to one another, as may be desired.

Another type of spanning system, shown in the Alcoa-Hico system, includes adjustable, aluminum shoring beams that have been designed and engineered to support concrete slab forms of various size thickness. The Alcoa-Hico beam is an adjustable horizontal aluminum shoring beam composed of two sections: an I beam section which telescopes into a box section. Both sections are locked in place by means of a steel bolt threaded through a steel nut plate attached to the lower chord of the box section. This locking arrangement enables the assembled beam sections to act in unison.

While such aforementioned spanning or structural supporting systems have many inherent advantages including being adjustable, providing good load bearing characteristics, providing positive setting of the beams, and being durable for long use, there are some inherent drawbacks. First of all, the above described spanning or structural supporting systems are relatively heavy and cumbersome, and this not only creates handling problems during installation, but also in removal and storage of such devices. Such prior art devices are also very costly because of the necessity of using substantial amounts of material to provide the necessary load bearing support that is desired, although both of the above described systems have sought ways, in either the construction of the device or in the type of material used, to minimize the amount of material, and therefore, the cost of such units. Despite these attempts, the cost of such prior art devices is higher than it needs to be. Finally, such prior art devices have not provided the desired adjustability and versatility, and thereby have limited the productivity of construction workers in using such prior art systems.

SUMMARY OF THE INVENTION

Among the several objects and advantages of the present invention include:

The provision of a new and improved structural supporting system for use as a temporary support in concrete slab construction and the like, for example, concrete falsework forming in bridge deck construction, which system overcomes the aforenoted deficiencies of the prior art;

The provision of the aforementioned structural supporting system which substantially reduces the amount of material and components required, as compared to prior art designs, while increasing versatility, adjustability and productivity in the use of such systems;

The provision of the aforementioned structural supporting system which includes overlapping form beams and a plurality of bracket means including end brackets at the opposite free ends of the overlapping form beams to support the overlapping form beams in the concrete slab construction, while permitting adjustment of the overlapping form beams through the use of at least one and preferably two intermediate bracket means which serve to provide adjustment of the overlapping form beams, in order to increase or reduce the span thereof;

The provision of the aforementioned structural supporting beams which include overlapping form beams that are made from lightweight materials such as wood, aluminum and the like;

The provision of the aforementioned structural supporting system which includes adjustable intermediate brackets having vertically adjustable and opposed gripping surfaces for engaging corresponding upper and lower surfaces of the overlapping form beams;

The provision of the aforementioned structural supporting system wherein the adjustable intermediate brackets provide simultaneous and equal load bearing forces on adjacent overlapping form beams;

The provision of the aforementioned structural supporting beam which permits the adjustable intermediate brackets to be quickly modified or changed to accept different sized overlapping beams so as to increase or reduce the span thereof, as desired;

The provision of the aforementioned structural supporting system which can be used on a wide variety of construction form settings in environments, depending upon the manner in which it is used; and The provision of the aforementioned structural supporting system which is inexpensive and easy to manufacture; is simple and easy to install and use; provides versatility and flexibility in the use of such systems in different construction environments; increases the productivity of construction workers in the use of such systems; is long wearing and durable in use; and is otherwise well adapted for the purposes intended.

Briefly stated, the structural supporting system of the present invention is constructed for use as a temporary support in concrete falsework construction and the like and includes a series of overlapping form beams and a plurality of cooperating bracket means positioned along the length of the overlapping form beams. The bracket means includes end bracket means positioned at an opposite free end of the overlapping form beams for mounting the overlapping form beams in the concrete falsework construction. The cooperating bracket means includes at least one other bracket means positioned intermediate the opposite free ends of the overlapping form beams and providing adjustable extension and collapse of the overlapping form beams for increasing or reducing the span of the overlapping form beams as desired.

Preferably, there are two intermediate bracket means and each of the two intermediate bracket means are equidistantly spaced relative to the centerline of the overlapping form beams. The intermediate bracket means are preferably also equidistantly spaced relative to the end bracket means at the opposite free ends of the overlapping form beams.

The end bracket means at the opposite free end of the overlapping form beams are each fixedly attached to the overlapping form beams while the intermediate bracket means are adjustably mounted to the overlapping form beams. Each end bracket means includes mounting means for suspended mounting of the overlapping form beams in the concrete falsework construction. Specifically, the mounting means includes support ears which extend laterally outwardly away from its associated end bracket means and an adjacent free end of the overlapping form beams for attachment to fastener means suspended in the concrete falsework construction.

The overhanging form beams are formed from laminated veneer lumber or aluminum, or other equivalent structure, in order to provide a lightweight construction.

The intermediate bracket means includes adjustable gripping means for at least partial gripping engagement and support of each of the overlapping form beams following positionment thereof along the overlapping form beams. In order to increase or reduce the span of the overlapping form beams, different sized overlapping form beams may be used, and the intermediate bracket means may be readily changed in height, to accommodate the different sized overlapping form beams.

The intermediate bracket is constructed as a vertically extending, complementary configured elongated body for receiving the overlapping form beams therein, and includes an adjustable gripping means for at least partially gripping and supporting each of the overlapping form beams following desired positionment of the at least one intermediate bracket means along the overlapping form beams. The adjustable brackets means includes generally vertically adjustable and opposed gripping surfaces for engaging corresponding upper and lower surfaces of the overlapping form beams. More specifically, the adjustable gripping means includes vertically adjustable surfaces positioned below the overlapping form beams for adjustably engaging the lower surfaces of the overlapping form beams and for forcing the upper surfaces of the overlapping form beams against a fixed upper wall of the hollow bracket body. The vertically adjustable surfaces positioned below the overlapping form beams are also arranged at different heights to accommodate overlapping form beams of different heights.

The adjustable gripping means includes two outer bearing elements at substantially the same level for underlying and engaging two outermost overlapping form beams and a lower level intermediate bearing element for underlying and engaging an intermediate vertically larger overlapping form beam. The intermediate bearing element is connected to threaded adjustment means for vertically adjusting the intermediate bearing element, and the intermediate bearing element also engaging the outer bearing elements for simultaneous vertical adjustment therewith. The intermediate bearing element is connected to the threaded adjustment means through a load element that applies force to the intermediate bearing element in the area of engagement with the outer bearing element for equal load bearing and simultaneous adjustment of the outer bearing elements and intermediate bearing element. The load element is constructed as a semi-circular shaped body having outer ends engaging the intermediate bearing element and having a median area thereof interconnected to the threaded adjustment means.

The elongated body includes spaced horizontal strut members on each side of the threaded adjustment means and load element with the horizontal strut members being connected to spaced vertically extending pairs of strut members on each side thereof which are attached to each other at an upper end thereof. Each of the outer bearing elements includes a U-shaped handle member extending around each pair of vertically extending strut members on opposite sides of the bracket means.

One of the end brackets, for engaging at least one free end of the overlapping form beams, includes two vertically extending and laterally spaced elongated hollow bodies each having an inner wall periphery at least partially complementary configured relative to one free end of the adjacent overlapping form beams. Each of the hollow bodies being capable of being fixedly attached to one free end of the adjacent from beams, and integral mounting means extending between the laterally spaced hollow bodies for mounting the end bracket and thereby one or both the adjacent form beams relative to the concrete form construction. The mounting means includes an integral support ear which extends laterally outwardly from the hollow body and an adjacent free end of the form beams. The integral mounting means preferably also includes a second support ear extending from the first support ear at a downwardly inclined angle thereto between and connected to the laterally spaced hollow bodies. For use of the bracket as an overhang support device, wedge means are positioned between an upper surface of an overlapping form beam and a corresponding upper inner surface of one or both hollow bodies.

Another type of end bracket, for at least one free end of the overlapping form beams, includes only one vertically elongated hollow body having an inner wall periphery at least partially complementary configured relative to the at least one free end of the overlapping form beams, the hollow body being fixedly attached to at least one free end of the overlapping form beams and including integral mounting means for mounting the end bracket and thereby the overlapping form beams relative to associated concrete forms. The integral mounting means includes an integral support ear which extends laterally outwardly from the hollow body and an adjacent free end of the overlapping form beams for attachment to fastener means suspended from the concrete form construction onto other supports.

These and other objects and advantages of the present invention will become more apparent from the ensuing description.

BRIEF DESCRIPTION OF THE DRAWINGS

In the drawings.

Corresponding reference numerals will be used throughout the various figures of the drawings.

DESCRIPTION OF THE PREFERRED EMBODIMENT

The following detailed description illustrates the invention by way of example and not by way of limitation. This description will clearly enable one skilled in the art to make and use the invention, and describes several embodiments, adaptions, variations, alternatives and uses of the invention, including what I presently believe is the best mode of carrying out the invention.

Figure 1:
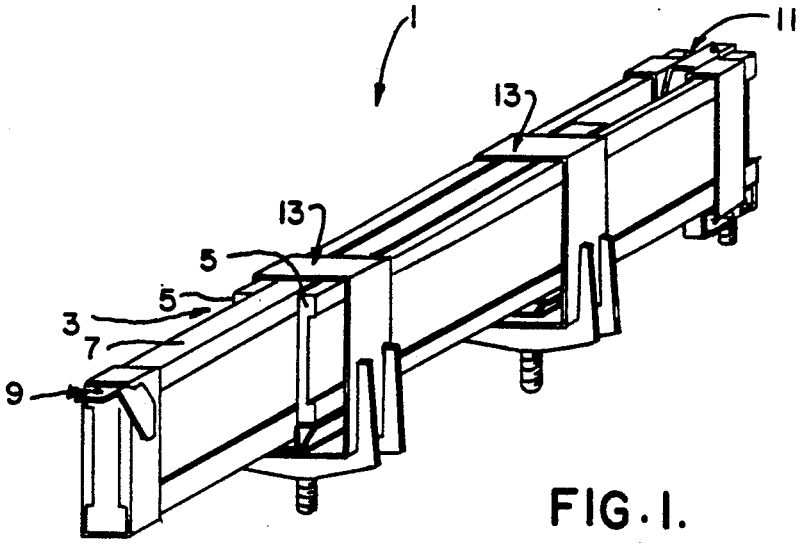
FIG. 1 is an isometric view of the structural support system of the present invention including overlapping form beams and associated end brackets at opposite free ends thereof, together with intermediate bracket means positioned therebetween.
Figure 2:
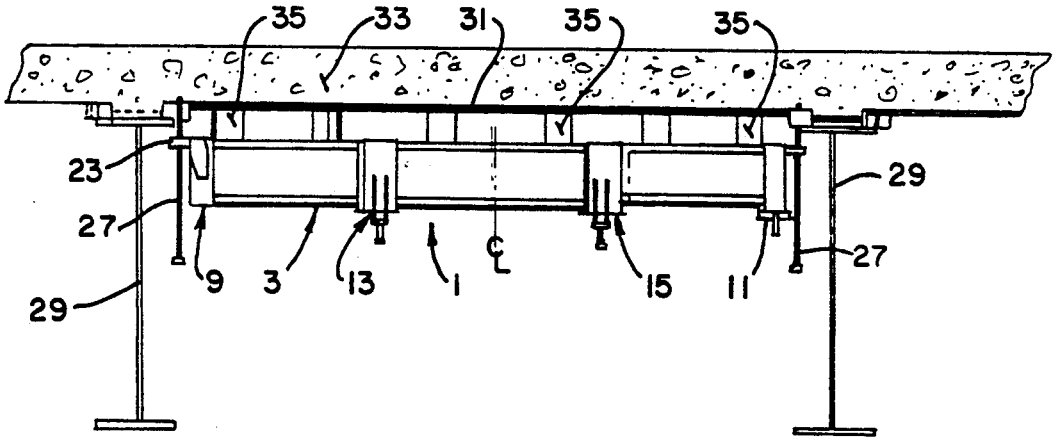
FIG. 2 is a fragmentary side elevational view illustrating the manner in which the structural supporting system of the present invention is used as a temporary support in concrete falsework construction.
Figure 3:
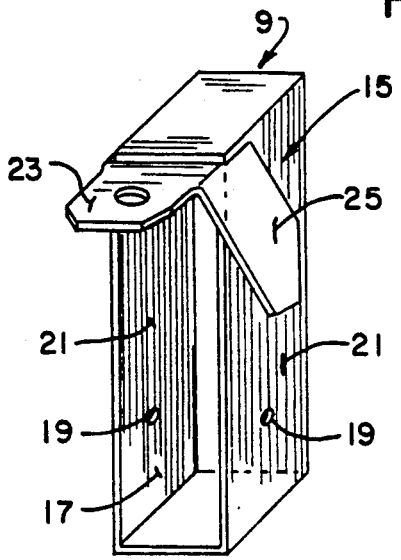
FIG. 3 is an isometric view of one type of end bracket used in the structural supporting system of the present invention.
Figure 8:
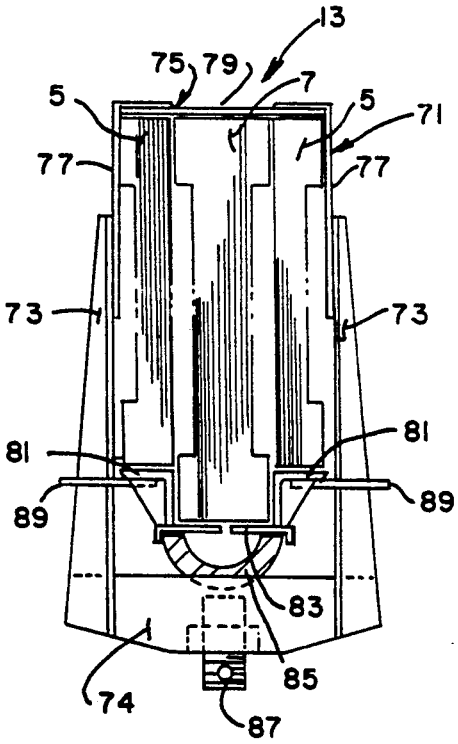
FIG. 8 is an end elevation view, partially in section, illustrating the manner in which the adjustable intermediate bracket provides opposed gripping engagement with corresponding upper and lower surfaces of the overlapping form beams.

As best seen in FIGS. 1–2 of the drawings, the structural supporting system 1 of the present invention is essentially an adjustable supporting beam which is constructed for use as a temporary support in concrete falsework construction and the like, i.e., bridge deck forming where concrete falsework construction is required. The structural supporting system or adjustable supporting beam 1 of the present invention includes a series of overlapping form beams 3 preferably comprising a pair of smaller outer form beams 5, 5 and a larger intermediate form beam 7, all of which are supported and held in overlapping relationship as best illustrated in FIGS. 1 and 8 of the drawings. In order to support and retain the overlapping form beams 3 the desired position, cooperating bracket means in the form of end brackets 9, 11 positioned at opposite free end of the overlapping form beams 3 mount and support the overlapping form beams 3 in the concrete falsework construction, as will become apparent, and at least one, but preferably two adjustable intermediate brackets 13, 13 are positioned intermediate the opposite free ends of the overlapping form beams 3 and provide adjustable extension and collapse of the overlapping form beams 3 in order to increase or reduce the span of the overlapping form beams 3, as desired.

As shown in FIG. 2 of the drawings, the two intermediate adjustable brackets 13, 13 are preferably equidistantly spaced relative to the centerline of the overlapping form beams, as well as the equidistantly spaced relative to the end brackets 9, 11 at opposite free ends of the overlapping form beams 3.

In the structural supporting system 1 of the present invention, the adjustable intermediate bracket 13 or brackets 13, 13 are very important because they allow laminated veneer lumber to be used as an adjustable supporting beam in concrete falsework construction. One preferred form of laminated veneer lumber of the kind used in the structural support system 1 of the present invention include the "MICRO=LAM" form beams (an associated bearing strips) which permit the various adjustments desired, while allowing reuse of the laminated veneer lumber. Such "MICRO=LAM" form beams are constructed as illustrated in the drawings. In lieu of wood, other lightweight materials such as aluminum or other equivalent structures may be employed, without sacrificing strength or reuse of the form beams.

The structural supporting system or adjustable form beams 1 of the present invention may be used in a variety of construction form environments or settings where an adjustable concrete form system, also known as an adjustable concrete waler system, may be employed. Some of these environments or settings are illustrated in the drawings, while others will be discussed in the description that follows.

In order to understand these different environments or settings where the structural supporting system or adjustable supporting beams of the present invention may be employed, reference is first made to the specific construction and features of the overlapping form beams and bracket components which form the structural supporting system or adjustable supporting beam 1 of the present invention.

The overlapping form beams 3 are preferably constructed as shown to include two outer form beams 5, 5 which have a generally flat C-shaped cross sectional configuration, as shown in FIGS. 1 and 8 of the drawings, with an intermediate longer and wider I-shaped in cross section intermediate beam 7 positioned between the two outer beams 5, 5. These wood (laminated veneer lumber), aluminum or other light weight material overlapping form beams 3 are used as illustrated in the drawings with the various bracket components described below in providing the adjustable concrete form or waler system of the present invention.

At one end of the overlapping form beams 3, an end bracket 9 is provided for a complementary association relative to the intermediate I-shaped in cross section elongated form beam 7. Specifically, the end bracket 9, as best seen in FIGS. 1–6 of the drawings, includes a vertically elongated hollow body 15 having an inner wall periphery 17 at least partially complementary configured relative to the outer free end of the intermediate form beam 7. Specifically, enlarged upper and lower ends of the I-shaped intermediate beam 7 are slightly smaller than the complementary inner wall periphery 17 of the vertically elongated hollow body 15 so as to be slidably received therein. Opposed holes 19, 19 are provided in the vertically extending side walls 21, 21 of the vertically elongated hollow body 15 into which nails N may be inserted and driven into the I-shaped in cross section intermediate form beam 7, thereby fixedly attaching the end bracket 9 to the one free end of the form beam 7.

The end bracket 9 further includes integral mounting means in the form of an integral support ear 23 which extends laterally outwardly from the hollow body 15 and an adjacent free end of the overlapping form beam 7, for attachment to fastener means in order to suspend overlapping form beams 7 in the concrete form construction, as will be discussed below. The integral support ear 23 includes side flaps 25, 25 which are welded or otherwise attached to the vertically extending side walls 21, 21 of the hollow body 15 form connected structural support between the hollow body 15 and the transversely or laterally outwardly extending integral support ear 23 The integral support ear 23 further includes a complementary hole or opening 27 for receipt of an elongated supporting fastener 27 as shown in FIG. 4, and further discussed below.

Figure 4:
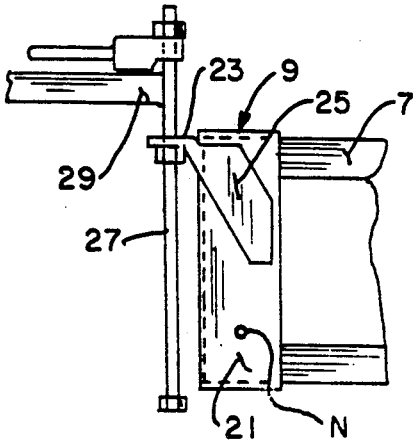
FIG. 4 is a fragmentary side elevational view illustrating the manner in which the end bracket of FIG. 3 is suspended by an associated fastener in concrete falsework construction.

An environmental setting or use for an adjustable concrete waler system, to be used as a suspended waler in bridge deck, for example, is best shown in FIGS. 2 and 4 of the drawings. The fasteners or adjustable coil bolts 27, 27 suspend the structural supporting or adjustable concrete waler system 1 by the adjustable coil bolts 27, 27 which are, in turn, mounted to existing overhang hangers 29, 29 in the concrete form construction. A three quarter inch plywood or form sheet 31 under lies the concrete construction 33, with spaced supporting wood blocks or supports 35 positioned between the structural supporting system for the adjustable concrete waler system 1 of the present invention. Thus, the structural supporting or adjustable concrete waler system 1 engages the spaced wood blocks or supports 35 along the length thereof, while the spaced wood supports 35 underlie and support the three quarter inch plywood or form sheet 31, to support and control construction loads of concrete 33, either as dead load or live load, as jobsite conditions warrant. Following setting of the concrete 33, the structural supporting or adjustable concrete waler system, along with the spaced wood supports 35 and concrete plywood or form sheet 31 may be removed as temporary supports in the concrete falsework construction, and reused at different locations, as will be apparent.

In the adjustable suspended waler system environment of FIG. 2, it will be noted that both end brackets 9 and Il are supported by the coil bolts 27, 27 extending from the existing hanger units 29, 29. Although the construction of the end bracket 11 will be discussed further below, for present purposes, it is to be understood that the end bracket 9 is primarily usable with the enlarged I-shaped form beam 7 in the environment of FIG. 4 or in other environments or settings, examples of which are shown in FIGS. 5 and 6 of the drawings.

Figure 5:
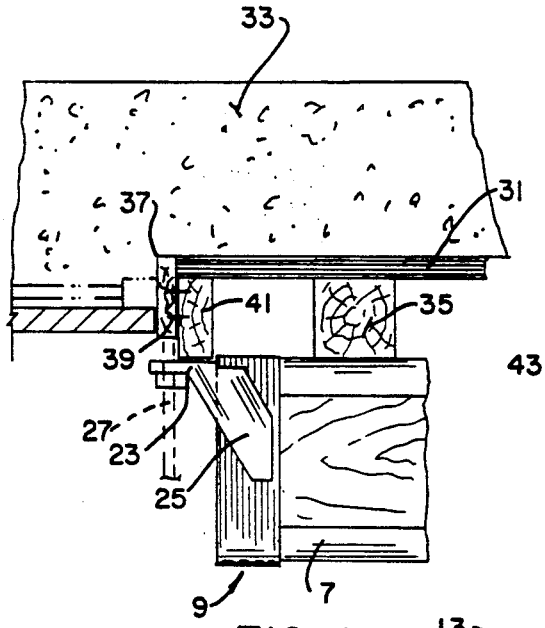
FIG. 5 is a fragmentary side elevational view with the end bracket of FIG. 3 used in a different concrete falsework construction setting for forming a vertically extending composite fillet as a concrete slab is formed.

In FIG. 5 of the drawings, an example of a concrete fillet 37 being formed as an integral part of the concrete slab construction 33, through the use of the end bracket 9 in the structural supporting system 1, is disclosed. Specifically, the fastener 27 suspends the end bracket 9 and associated form beam 7 through its supporting ear 23, relative to an existing hanger unit, as described previously. To form the fillet 37, a one by four fillet form 39 is nailed to a wood support 41, the wood support 41 also underlying the plywood form sheet 31, while being supported by the laterally or transversely extending support ear 23, immediately behind the fastener 27. Thus, the supporting ear 23 allows the support 41 to form and support the fillet, through the nailed wood fillet form 39, while underlying the plywood form sheet 31. This will produce the concrete slab construction with the vertically extending fillet 37, as shown in FIG. 5.

Figure 6:
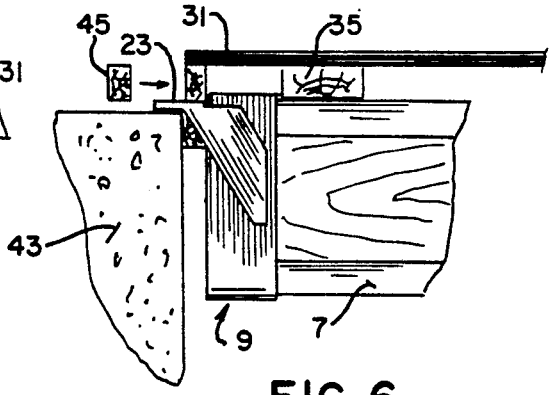
FIG. 6 is a fragmentary side elevation view showing the end bracket of FIG. 3 used in a wall bearing concrete falsework construction environment.

FIG. 6 shows the use of the end bracket 9, together with elongated form beam 7, in a wall bearing environment or setting. Note in FIG. 6 that there is no supporting fastener 27, but rather the transversely or laterally extending support ear 23 rests upon and is supported by a concrete wall 43 as shown. Prior to pouring of the concrete, wall edge wood blocks 45 are placed over the support ear 23 to protect same from the concrete poured over to the supporting ear 23. The support ear 23 should be greased, prior to concrete pouring, to assure ease of stripping the support ear 23 and the end bracket 9 from the poured concrete construction.

It will be apparent that the end bracket 9 may be used in other settings or environments, such as in box culverts and other environments, with FIGS. 2, 5 and 6 serving as representative examples of the many different and varied ways in which the end bracket 9 may be used in the structural supporting or adjustable concrete waler system 1 of the present invention.

Figure 9:
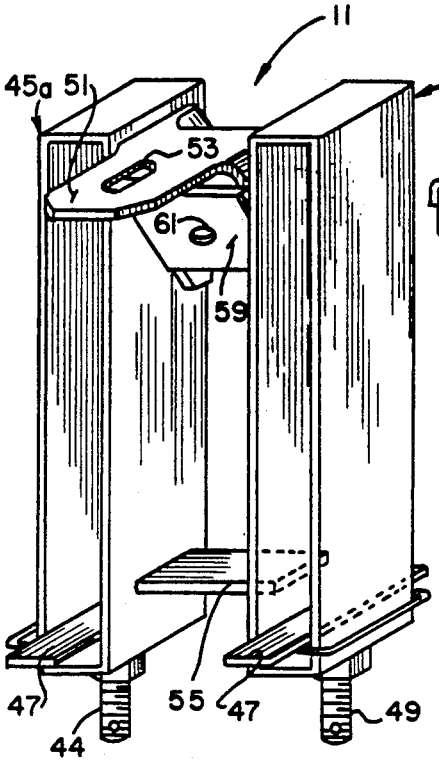
FIG. 9 is an isometric view of another type of end bracket used in the structural supporting system of the present invention.
Figure 10:
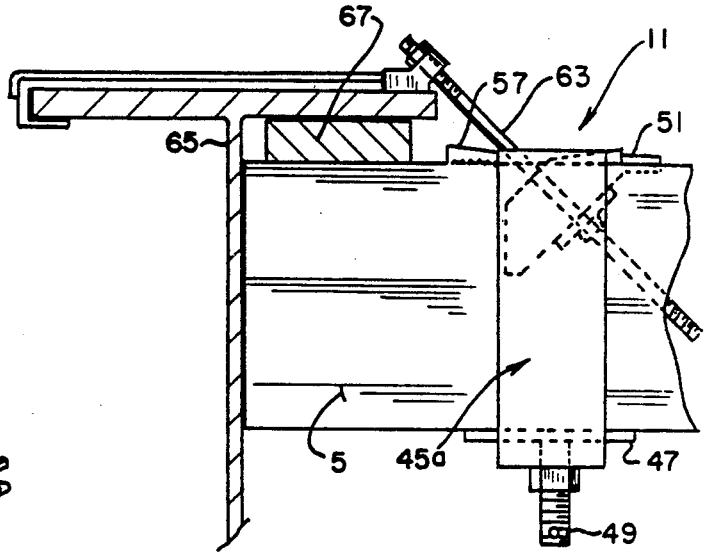
FIG. 10 is a fragmentary side elevational view illustrating the manner in which the end bracket of FIG. 9 is used in an overhang support construction form setting.
Figure 11:
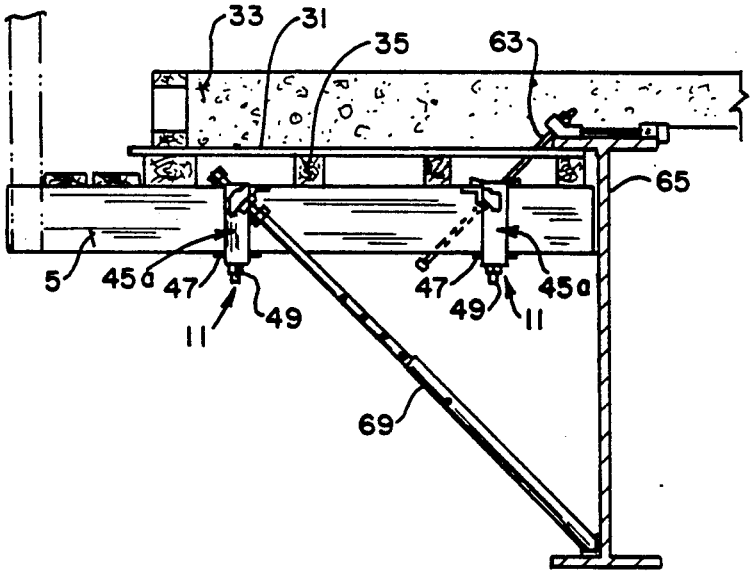
FIG. 11 is a fragmentary side elevational view showing two brackets of the type illustrated in FIG. 9 for use in a heavy overhang concrete form construction setting.

Reference is now made to FIGS. 9–11 of the drawings for a description of the construction of the end bracket 11 which may also be used as an overhang support bracket, as will become apparent. In the environment of FIGS. 1–2, the end bracket 11 is shown as engaging the two outer form beams 5, 5 in spaced and supported relationship, with the end bracket 11 also being supported by the fastener 27 in the concrete falsework construction, as shown in FIG. 2.

For the above purposes, the end bracket 11 shown in FIG. 9 of the drawings includes two vertically extending and laterally spaced elongated hollow bodies 45*a*, 45*a* of the same overall configuration. In the suspended waler system of FIGS. 1–2, the two vertically extending and laterally spaced elongated hollow bodies 45*a*, 45*a* of the end bracket 11 are internally complementary configured to receive the outer form beams 5, 5, as illustrated in FIGS. 1–2. At the bottom of each elongated body 45*a*, there is provided a load plate 47 which is vertically adjustable by way of the threaded bolt 49 which provides vertically adjustable gripping means for adjustably and fixedly attaching each hollow body 45*a* to one of the outer form beams 5. Simple threaded adjustment of each bolt 49 moves the load plate 47 into and out of engagement relative to an associated form beam 5, thereby permitting attachment or removal of the end bracket relative to the outer form beams 5, as will be appreciated.

In order to mount the end bracket 11 to a fastener 27 suspended from a hanger unit 29 in a concrete falsework construction environment, as shown in FIGS. 1–2, integral mounting means extend between the laterally spaced hollow bodies 45*a*, 45*a* of the end bracket in the form of an integral support ear 51 which also extends laterally or transversely outwardly relative to the elongated hollow bodies 45*a* and includes an opening 53 for reception of the coil bolt fastener 27, for mounting the end bracket II, as shown in FIG. 2 of the drawings. A structural supporting plate 55 extends between the two spaced hollow bodies 45a, 45a adjacent a lower end thereof for stabilizing the end bracket 11, as will be apparent.

In certain cases, the end bracket 11 can be used on both ends of form beams 5, 5 in short span applications where a minimum quantity of walers is needed. In such circumstances, neither the end bracket 9 nor one or more of the intermediate adjustable brackets 13 are required since the end bracket 11, on such short span applications, can be mounted at both ends of two outer form beams 5, 5 meeting all of the requirements of such short span applications.

Instead of being used in an end bracket application, the bracket 11 may also be used as a support bracket in an overhang support application. Specifically, with reference to FIG. 10 of the drawings, after the outer form beams are placed in the support bracket 11, a load key or wedge 57 is positioned between an upper surface of an outer form beam 5 and a corresponding upper inner surface of the hollow body 45a to facilitate use of the bracket 11 as an overhang support device. Following insertion of the load key or wedge device 57 in the above described manner, the load key or wedge 57 is secured to the form beam 5 or the like so as to remove all pre-load movement The support bracket 11 further includes a second support ear 59 extending from the first support ear 51 at a downwardly inclined angle thereto between and connected to the laterally spaced hollow bodies 45a, 45a. As shown in the overhang support application of FIG. 10, the second support ear 59, with associated fastener hole 61, enables a coil bolt 63 depending from the hanger device 65 as shown in FIG. 10, to extend through the hole 61 of the downwardly inclined second support ear 59 for mounting the support bracket 11 as an overhang support device, as shown in FIG. 10. A wood block 67 may be inserted between a lower horizontal surface of the hanger unit 65 and an upper surface of the outer beams 5 to provide a stable and secure mounting with respect thereto.

In another application where a heavy load or wide overhang require special application forming, the support bracket 11 may be used in the manner shown in FIG. 11 of the drawings. In this environmental setting, two spaced end brackets 11, 11 are mounted relative to the outer form beams 5 so as to support the spaced wood blocks 35 which underlie the plywood or form sheet 31 for forming the overhang concrete construction 33 as shown in FIG. 11 of the drawings. It will be appreciated that the second support ears 59 are utilized for mounting the support bracket 11 at the right hand side of FIG. 11 to the hanger unit 65, much after the fashion of the FIG. 10 embodiment, but also the second support ears 59 will enable the support bracket 11 at the left hand side of FIG. 11 to be mounted relative to the supporting leg extension 69 which extends from the bottom of the hanger unit 65 and the left side positioned support bracket 11 through an associated second support ear 59, as illustrated in FIG. 11 of the drawings.

It will be apparent that other types of uses, in various environmental settings, may be found for the end or support bracket 11 including overhangs with sloping surfaces and other applications that may be desired by the user.

Reference is now made to the adjustable mounting bracket 13 which is an important and essential element in the adjustable concrete waler system illustrated in FIGS. 1-2 of the drawings. The adjustable mounting bracket 13 may be used as a single intermediate adjustable bracket in the adjustable concrete waler system shown in FIGS. 1-2 of the drawings; however, preferably there are two such bracket means which are equidistantly spaced from a center line of the overlapping form beams, and in some applications, also equidistantly spaced from the end brackets 9, 11.

In the adjustable concrete waler system illustrated in FIGS. 1-2 of the drawings, the adjustable mounting bracket or brackets 13 are constructed to engage the two outer form beams and the intermediate longer and wider I-shaped in cross section beam 7, which is positioned between the two outer beams 5, 5, as best shown in FIG. 8 of the drawings.

For this purpose, the adjustable mounting bracket 13 has a vertically extending, complementary configured elongated body 71 for receiving the spaced outer form beams 5, 5 and the intermediate form beams 7 therein. The body 71 of the adjustable mounting bracket 31 is constructed through the use of a pair of vertical strut members 73, 73 on opposite sides of the elongated body 71. Each of the vertical struts 73 has an L-shaped in cross section configuration which tapers and increases in dimension from the upper to the lower end thereof, as will be readily apparent. Attached to the upper ends of the spaced pairs of vertical strut members 73, 73 on opposite sides of the body 71 is a cap member 75, the side sections 77, 77 of which are welded or otherwise secured to the upper ends of the spaced pairs of vertical strut members 73, and a top section 79 interconnecting the side section 77, 77 to provide the cap member 75. For enlarging or reducing the size of the overlapping form beams in different spanning applications, as will be discussed further below, the side sections 77, 77 of the caps 75 may be reduced or enlarged as desired to accommodate different sized overlapping form beams. At the bottoms of the vertical strut members 73, 73, horizontal strut members 74, 74 connect one vertical strut member 73 on each side of the elongated hollow body 71.

Figure 7:
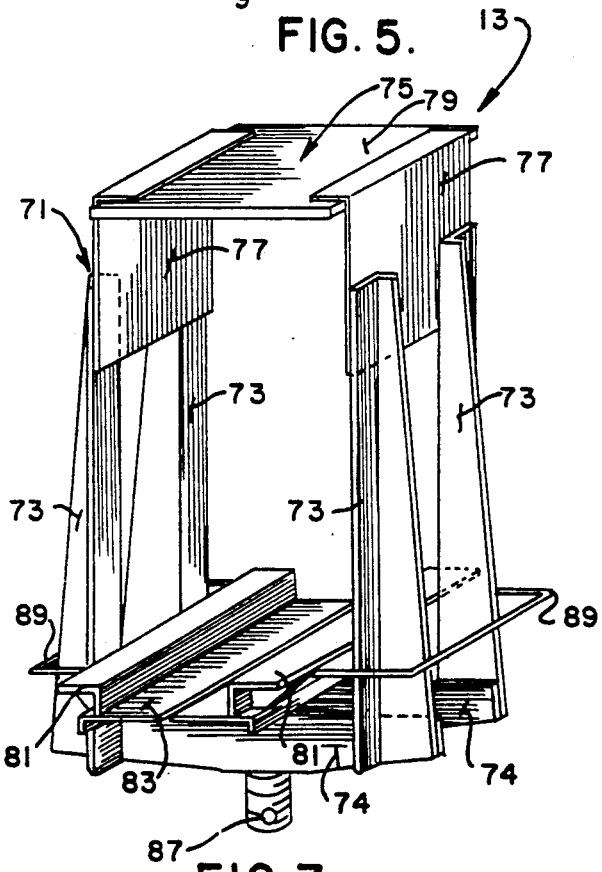
FIG. 7 is an isometric view of the adjustable intermediate bracket used in the structural supporting system of the present invention.

Each adjustable mounting bracket 13 includes vertically adjustable and opposed gripping surfaces for engaging upper and lower surfaces of the overlapping form beams 5, 5 and 7. In this regard, the adjustable gripping means is illustrated in FIGS. 7-8 of the drawings as including two outer bearing elements 81, 81, similarly constructed as L-shaped elements, and a lower level intermediate element 83 which is attached to the two outer bearing elements 81, 81 for underlying and engaging the overlapping form beams. The intermediate bearing element is supported by a semi-circular shape load rim or element 85 which is welded or otherwise attached to the threaded load bolt adjustment means 87. By threadably adjusting the load bolt 87, the load element 85 will impart vertically adjustable gripping forces on the overlapping form beams 5, 5 and 7 by adjustably engaging the lower surfaces of such overlapping form beams and forcing the upper surfaces of such overlapping form beams against the fixed upper wall or top section 79 of the elongated body 71.

Specifically, it will be seen that the L-shaped outer bearing elements 81, 81 have the lower or vertical leg thereof attached to the intermediate bearing element 83 in general alignment with the load rim or load element 85, thereby applying equal load bearing and simultaneously adjustment of the outer bearing elements 81, 81 along with the intermediate bearing element 85. This can best be seen in FIG. 8 of the drawings where the intermediate form beam 7 rests upon the intermediate bearing element 83 while the outer form beams 5, 5 rests upon the outer bearing elements 81, 81. Upon tightening of the load bolt 87, the load element or rim 85 applies equal load bearing and simultaneous forces through the intermediate bearing element 83 and the outer bearing elements 81, 81 to apply vertically adjustable gripping forces to the lower surfaces of the overlapping form beams, for adjustably engaging the lower surfaces of the overlapping form beams and forcing the upper surfaces of the overlapping form beams against the fixed upper wall or top section 77 of the elongated body 71. Each outer bearing element includes a U-shaped handle member 89 extending around and outside of the vertically extending and spaced strut members 73, 73 for controlling the bearing elements 81, 81 while installation and adjustment of the form beams is completed.

As explained above, by reducing the height of the vertical sections 77, 77 of the cap 75 or by inserting same within the strut members 73, 73 so as to provide a shorter vertical height elongated body 71, a different sized adjustable mounting bracket 13 may be provided. This enables the thus constructed adjustable mounting bracket to be used on shorter spans since it accommodates smaller sized overlapping form beams.

From the foregoing, it will now be appreciated that the structural supporting system of the present invention, together with the overlapping form beams and various bracket components, usable by themselves or together in an adjustable concrete waler system, provides an extremely versatile and flexible structural supporting system for a wide variety of concrete construction forms, primarily usable in concrete falsework construction as in bridge decks and concrete slab construction. It has been shown that some of the adjustable bracket or supporting brackets may be used in different environments or settings by themselves independently of the other elements, or in conjunction with the other brackets, dependent upon the particular application.

In view of the above, it will be seen that the several objects and features of this invention are achieved and other advantageous results obtained.

As various changes could be made in the above constructions without departing from the scope of the invention, it is intended that all matter contained in the above description or shown in the accompanying drawings shall be interpreted as illustrative and not in a limiting sense.

I claim:

1. In a structural supporting system for temporary support in concrete falsework construction including a series of adjacent overlapping form beams and a plurality of cooperating bracket means positioned along the length of said adjacent form beams, the improvement comprising:

at least one intermediate bracket between opposite free ends of said overlapping form beams and having a vertically extending, complementary configured elongated body for receiving the overlapping form beams therein, and adjustable gripping means for at least partial gripping engagement and support of each of said overlapping form beams following desired positionment of said at least one bracket means along said overlapping form beams, the height said intermediate bracket being changeable for different size form beams to increase or reduce the span of said overlapping form beams, said adjustable gripping means including generally vertically adjustable and opposed gripping surfaces for engaging upper and lower surfaces of said overlapping form beams, said vertically adjustable surfaces positioned below said overlapping form beams are also arranged at different heights to accommodate overlapping form beams of different heights, said adjustable gripping means includes two outer bearing elements at substantially the same level for underlying and engaging to spaced outermost overlapping form beams and a lower lever intermediate bearing element for underlying and engaging an intermediate vertically larger overlapping form beam, said intermediate bearing element being connected to threaded adjustment means for vertically adjusting the intermediate bearing element and said intermediate bearing element also engaging said outer bearing elements for simultaneous vertical adjustment therewith.

2. In a structural supporting system for temporary support in concrete falsework construction including a series of adjacent overlapping form beams and a plurality of cooperating bracket means positioned along the length of said adjacent form beams, the improvement comprising:

at least one intermediate bracket between opposite free ends of said overlapping form beams and having a vertically extending, complementary configured elongated body for receiving the overlapping form beams therein, an adjustable gripping means for at least partial gripping engagement and support of each of said overlapping form beam following desired positionment of said at least one bracket means along said overlapping form beams, the height of said intermediate bracket is changeable for different size form beams to increase or reduce the span of said overlapping form beams, said adjustable gripping means includes generally vertically adjustable and opposed gripping surfaces for engaging upper and lower surfaces of said overlapping form beams, said vertically adjustable surfaces positioned below said overlapping form beams are also arranged at different heights to accommodate overlapping form beams of different heights, said adjustable gripping means includes two outer bearing elements at substantially the same level for underlying and engaging two spaced outermost overlapping form beams and a lower level intermediate bearing element for underlying and engaging an intermediate vertically larger overlapping form beam.

3. The improvement as defined in claim 1 wherein said intermediate bearing element is connected to said threaded adjustment means through a load element that applies force to said intermediate bearing element in the area of engagement with said outer bearing elements for equal load bearing and simultaneous adjustment of said outer bearing elements and intermediate bearing element.

4. The improvement as defined in claim 3 wherein said load element includes a semi-circular shaped body having outer ends engaging said intermediate bearing element and having a median area thereof interconnected to said threaded adjustment means.

5. The improvement as defined in claim 4 wherein said elongated hollow body includes spaced horizontal strut members on each side of said threaded adjustment means and load element, said horizontal strut members being connected to spaced vertically extending pairs of strut members on each side thereof which are attached to each other at an upper load thereof.

6. The improvement as defined in claim 5 wherein each said outer bearing element includes a U-shaped handle member extending around and outside said pair of vertically extending and spaced strut members on opposite sides of said bracket means.

* * * * *